US007848672B2

(12) United States Patent
Smith

(10) Patent No.: US 7,848,672 B2
(45) Date of Patent: Dec. 7, 2010

(54) FUSERS INCLUDING HEATER FOR PRE-HEATING FUSER BELT, PRINTING APPARATUSES AND METHODS OF FUSING TONER ON MEDIA WITH PRE-HEATING OF FUSER BELT

(75) Inventor: Nathan E. Smith, Hamlin, NY (US)

(73) Assignee: Xerox Corporation, Norwalk, CT (US)

( * ) Notice: Subject to any disclaimer, the term of this patent is extended or adjusted under 35 U.S.C. 154(b) by 79 days.

(21) Appl. No.: 12/244,320

(22) Filed: Oct. 2, 2008

(65) Prior Publication Data

US 2010/0086324 A1 Apr. 8, 2010

(51) Int. Cl.
*G03G 15/20* (2006.01)

(52) U.S. Cl. ..... 399/67; 399/329

(58) Field of Classification Search ..... 399/67–70, 399/329; 219/216
See application file for complete search history.

(56) References Cited

U.S. PATENT DOCUMENTS 6,266,510 B1 * 7/2001 Curry et al. ..... 399/329
6,469,279 B1 * 10/2002 Ohtsuka ..... 219/216
6,564,033 B2 5/2003 Zhou et al.
7,228,082 B1 6/2007 Davidson et al.
2003/0228179 A1 12/2003 Yaomin et al.
2005/0006370 A1 1/2005 Suzumi
2005/0036809 A1 2/2005 Fukita et al.

* cited by examiner

*Primary Examiner*—Hoang Ngo
(74) *Attorney, Agent, or Firm*—Ronald E. Prass, Jr.; Prass LLP

(57) ABSTRACT

Fusers, printing apparatuses and methods of fusing toner on media are disclosed. An embodiment of the fusers comprises a pressure roll including an outer surface; a continuous fuser belt including an inner surface and an outer fusing surface contacting the outer surface at a nip; and a heater disposed inside of the fuser belt, the fuser belt being rotatable relative to the heater. The heater includes at least one heating surface contacting the inner surface and adapted to pre-heat a portion of the fuser belt before the portion is rotated to the nip, and to heat the pre-heated portion at the nip.

14 Claims, 7 Drawing Sheets

FUSERS INCLUDING HEATER FOR PRE-HEATING FUSER BELT, PRINTING APPARATUSES AND METHODS OF FUSING TONER ON MEDIA WITH PRE-HEATING OF FUSER BELT

BACKGROUND

Fusers, printing apparatuses and methods of fusing toner on media are disclosed.

In some printing processes, toner images are formed on media and the media are then heated to fuse (fix) the toner onto the media. Printing apparatuses that are used for such printing processes can include a fuser having a fuser member and a pressure roll. During printing processes, media carrying toner images are fed to a nip between the fuser member and pressure roll, which apply heat and pressure to the media to fuse the toner images.

It would be desirable to provide apparatuses and methods for fusing toner on media efficiently.

SUMMARY

Embodiments of fusers, printing apparatuses and methods of fusing toner on media are disclosed. An embodiment of the fusers comprises a pressure roll including an outer surface; a continuous fuser belt including an inner surface and an outer fusing surface contacting the outer surface at a nip; and a heater disposed inside of the fuser belt, the fuser belt being rotatable relative to the heater. The heater includes at least one heating surface contacting the inner surface and adapted to pre-heat a portion of the fuser belt before the portion is rotated to the nip, and to heat the pre-heated portion at the nip.

DRAWINGS

DETAILED DESCRIPTION

The disclosed embodiments include a fuser comprising a pressure roll including an outer surface; a continuous fuser belt including an inner surface and an outer fusing surface contacting the outer surface at a nip; and a heater disposed inside of the fuser belt. The fuser belt is rotatable relative to the heater. The heater includes at least one heating surface contacting the inner surface and adapted to pre-heat a portion of the fuser belt before the portion is rotated to the nip, and to heat the pre-heated portion at the nip.

The disclosed embodiments further include a fuser comprising a pressure roll including an outer surface; a continuous fuser belt including an inner surface and an outer fusing surface which contacts the outer surface at a nip; and a heater disposed inside of the fuser belt. The fuser belt is rotatable relative to the heater. The heater includes a concave-shaped heating surface contacting the inner surface at the nip to heat the fuser belt.

The disclosed embodiments further include a method of fusing toner on a medium, which comprises feeding a medium having toner thereon to a nip between an outer fusing surface of a continuous fuser belt and an outer surface of a pressure roll; rotating the fuser belt relative to a heater disposed inside of the fuser belt, the heater including at least one heating surface contacting an inner surface of the fuser belt, the heating surface pre-heating a portion of the fuser belt before the portion is rotated to the nip and heating the pre-heated portion of the fuser belt at the nip; and contacting the medium with the fusing surface and the outer surface at the nip to fuse the toner onto the medium.

Figure 1:
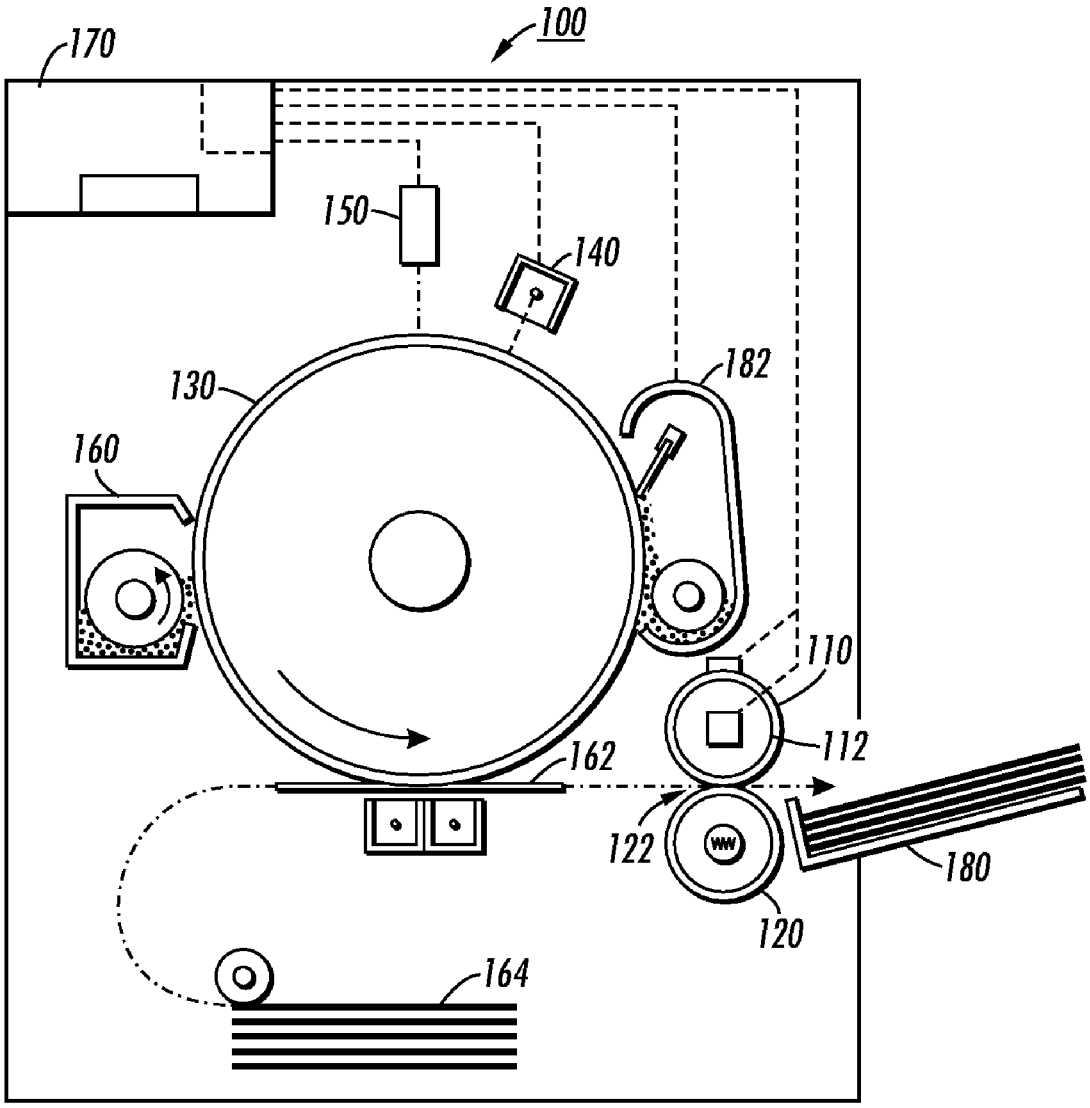
FIG. 1 illustrates an exemplary embodiment of a printing apparatus.

FIG. 1 illustrates an exemplary printing apparatus 100, such as disclosed in U.S. Pat. No. 7,228,082, which is incorporated herein by reference in its entirety. As used herein, the term "printing apparatus" encompasses any apparatus, such as a digital copier, bookmaking machine, multifunction machine, and the like, that performs a print outputting function for any purpose. The printing apparatus 100 can be used to produce prints from various media, such as coated or uncoated (plain) paper sheets, having various sizes and weights.

The printing apparatus 100 includes a fuser 110 with a rotatable, continuous belt 112 and a pressure roll 120 defining a nip 122. The printing apparatus 100 further includes a rotatable photoreceptor 130. To form a toner image on the photoreceptor 130, a charging device 140 is activated to charge the outer surface of the photoreceptor 130. The photoreceptor 130 is rotated to an exposure device 150, which forms an electrostatic latent image on the photoreceptor 130. Then, the photoreceptor 130 is rotated to a developer device 160, which applies toner particles to the electrostatic latent image to form the toner image on the photoreceptor 130. The toner image is transferred from the photoreceptor 130 to a medium 162, e.g., a sheet of paper, conveyed from a sheet supply stack 164. The medium 162 carrying the toner image is conveyed to the nip 122 of fuser 110. The printing apparatus 100 includes a controller 170 adapted to control operation of the image-forming devices during printing. After the medium 162 passes through the nip 122, the medium is conveyed to an output tray 180. A cleaning device 182 removes residual toner particles from the photoreceptor 182 before the imaging process is repeated for another medium.

Figure 2:
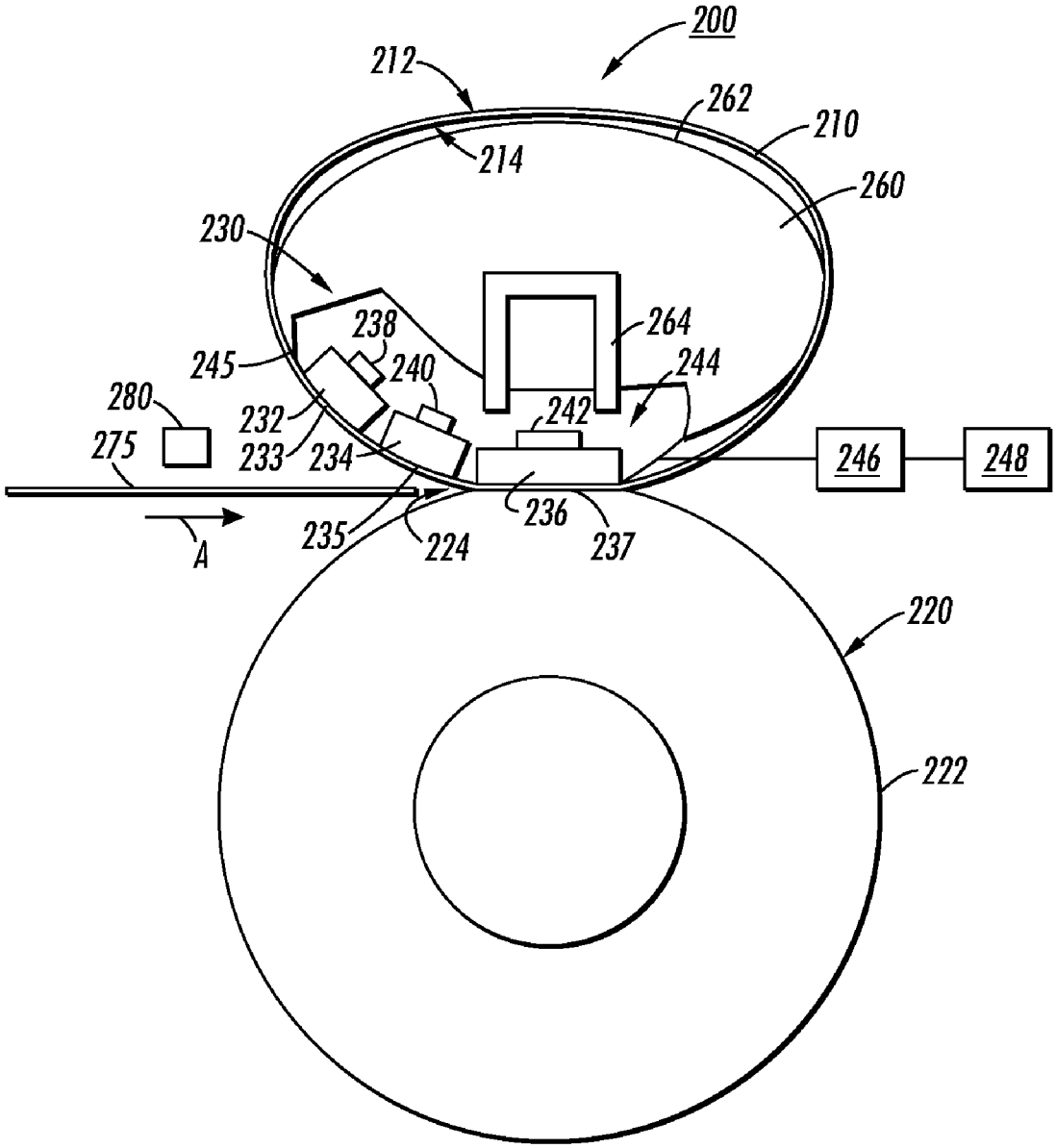
FIG. 2 illustrates an exemplary embodiment of a fuser.

FIG. 2 illustrates a fuser 200 according to an exemplary embodiment. Embodiments of the fuser 200 shown in FIG. 2 can be used, e.g., in the printing apparatus 100 in place of the fuser 110. The fuser 200 includes a continuous fuser belt 210 having an outer fusing surface 212 and an inner surface 214, and a pressure roll 220 having an outer surface 222 contacting the fusing surface 212 at a nip 224. The fuser belt 210 rotates counter-clockwise, while the pressure roll 220 rotates clockwise, to convey media, such as medium 275, though the nip 224 in direction A.

The fuser belt 210 can be comprised of a metal or metal alloy, such as steel, stainless steel, or the like. In embodiments, the fuser belt 210 is cylindrical shaped when in an un-deformed condition, and elastically deformable. The fuser belt 210 typically has a wall thickness of about 0.02 mm to about 0.05 mm. The fusing surface 212 can be coated with a material having heat resistance and low-friction properties, such as polytetrafluoroethylene (PFTE), perfluoroalkoxy (PFA), or the like.

The fuser 200 further includes a heater 230. In embodiments, the heater 230 is stationary. The heater 230 is adapted to pre-heat a portion of the fuser belt 210 before the portion rotates to the nip 224, and to also heat the pre-heated portion of fuser belt 210 at the nip 224. The heater 230 includes at least two heating elements for heating the fuser belt 210. In the illustrated embodiment, the heater 230 includes a first pre-nip heating element 232, second pre-nip heating element 234 located counter-clockwise from first pre-nip heating element 232, and a nip heating element 236 located at nip 224 counter-clockwise from second pre-nip heating element 234. In other embodiments, the heater 230 can include a single pre-nip heating element, more than two pre-nip heating elements and/or more than one nip heating element.

The first pre-nip heating element 232 has a heating surface 233, the second pre-nip heating element 234 has a heating surface 235, and the nip heating element 236 has a heating surface 237. The heating surfaces 233, 235 and 237 face the inner surface 214 of the fuser belt 210. In embodiments, the heater 230 extends clockwise by an angle up to about 45° from nip 224.

In embodiments, the heating surfaces 233, 235, 237 each extend axially along the fuser belt 210. The heating surfaces 233, 235, 237 are configured to heat the inner surface 214 of fuser belt 210 by thermal conduction. A thermally-conductive lubricant can be applied to the inner surface 214 to reduce friction between the heating surfaces 233, 235, 237 and inner surface 214 during rotation of the fuser belt 210.

As shown in FIG. 2, the heater 230 includes a thermistor 238 on the first pre-nip heating element 232, a thermistor 240 on the second pre-nip heating element 234, and a thermistor 242 on the nip heating element 236. Two or more, axially-spaced thermistors can be used with each of the first pre-nip heating element 232, second pre-nip heating element 234, and nip heating element 236.

In embodiments, the first pre-nip heating element 232, second pre-nip heating element nip 234, and nip heating element 236 are secured to a heater housing 244. The heater housing 244 extends axially along the fuser roll 210. The first pre-nip heating element 232, second pre-nip heating element 234, and nip heating element 236 can be received in respective axially-extending slots in the bottom surface 245 of the heater housing 244, and bonded to the heater housing 244. The heater housing 244 can comprise, e.g., a polymeric material.

In embodiments, a power supply 246 is connected to the first pre-nip heating element 232, second pre-nip heating element nip 234, and nip heating element 236. A controller 248 is connected to the power supply 246 to control the supply of power to the first pre-nip heating element 232, second pre-nip heating element nip 234 and nip heating element 236 either simultaneously, or at different times, to heat the fuser belt 210. For example, the first pre-nip heating element 232 can be powered first, then the second pre-nip heating element nip 234, and then the nip heating element 236. In embodiments, the controller 248 is also connected to the thermistors 238, 240, 242.

Figure 3:
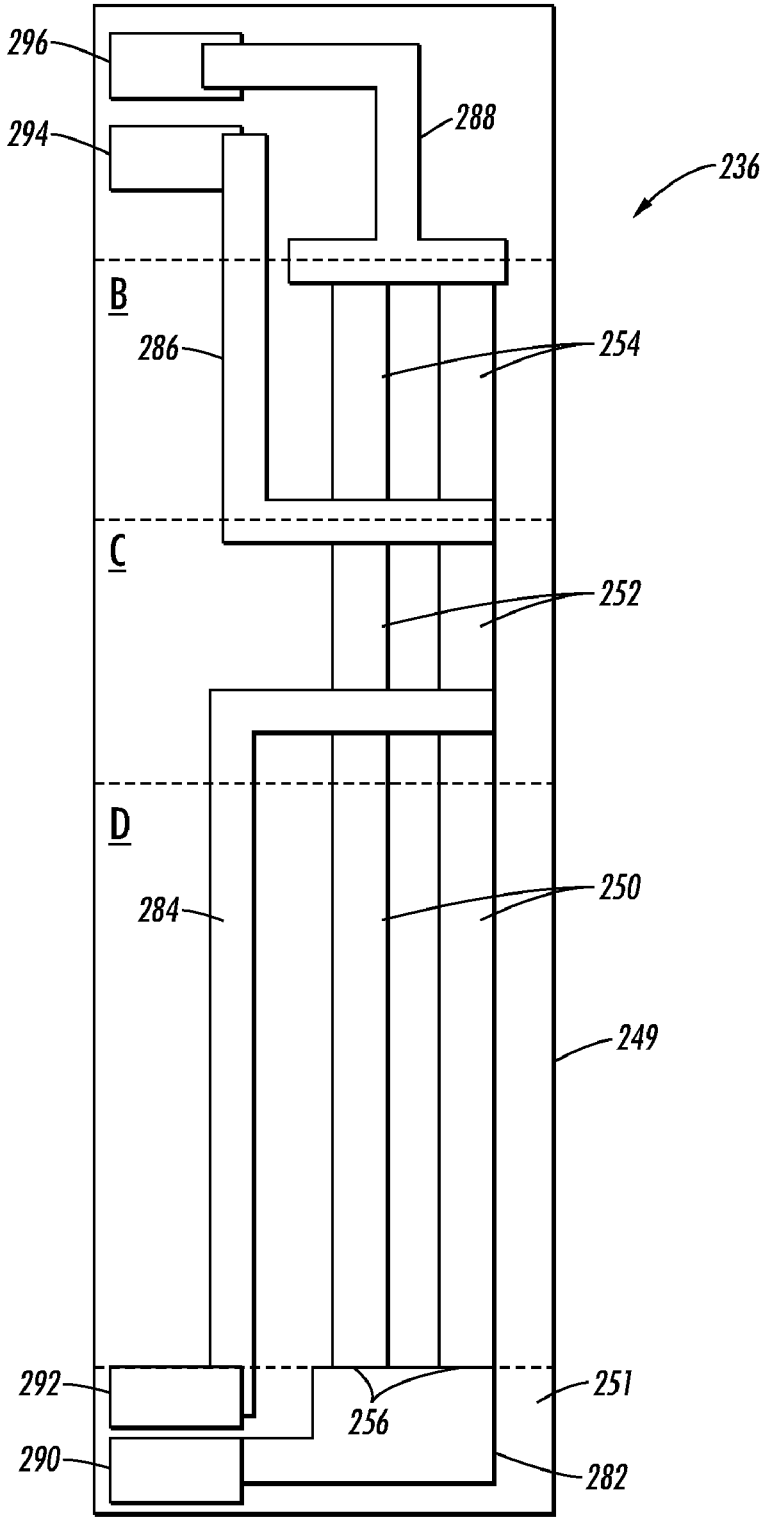
FIG. 3 illustrates an exemplary embodiment of a heating element.

FIG. 3 shows an exemplary embodiment of nip heating element 236. The illustrated nip heating element 236 includes a substrate 249 having a surface 251 opposite to heating surface 237, and resistive traces 250, 252, 254 formed on the surface 251. The substrate 249 can be made of a dielectric ceramic material, such as aluminum oxide, aluminum nitride or the like, or a polymeric material. The substrate 249 can typically have a width of about 10 mm to about 20 mm and a length of about 300 mm to about 400 mm. The resistive traces 250, 252, 254 can be comprised of an electrically-resistive material, such as $RuO_2$, $Ta_2N$, Ag/Pd, or the like. The nip heating element 236 includes electrical conductors 282, 284, 286, 288 connected to the resistive traces. Electrical connections 290, 292, 294, 296 are connected to conductors 282, 284, 286, 288, respectively, and to power supply 246. In embodiments, at least one thermistor is operatively associated with the resistive traces 250, 252, 254. The resistive traces 250 include an edge 256. The edge 256 can be aligned with a registration edge of media fed to the nip 224.

The resistive traces 250, 252, 254 can be covered by a protective material forming the heating surface 237. The protective material can be a thermally-conductive, dielectric material. The first pre-nip heating element 232 and second pre-nip heating element nip 234 can also include a protective material forming heating surfaces 233, 235.

As shown, the substrate 249 (and heating surface 237) has zones B, C and D. In embodiments, the resistive traces 250, 252, 254 can heat a selected axial length of the fusing surface 212 based on the width of media fed to the nip 224. To heat zone B, connections 294 and 296 are closed to heat resistive traces 254. To heat zones B and C, connections 292, 296 are closed (with connection 294 open) to heat resistive traces 252, 254. To heat zones B, C and D, connections 290, 296 are closed (with connections 292, 294 open) to heat resistive traces 250, 252, 254.

In embodiments, the first pre-nip heating element 232 and second pre-nip heating element 234 can have the same construction, and the same or different dimensions, as the nip heating element 236. In the illustrated embodiment, the first pre-nip heating element 232 and second pre-nip heating element 234 are narrower (i.e., they face a smaller arc length of fuser belt 210) than the nip heating element 236.

Figure 4:
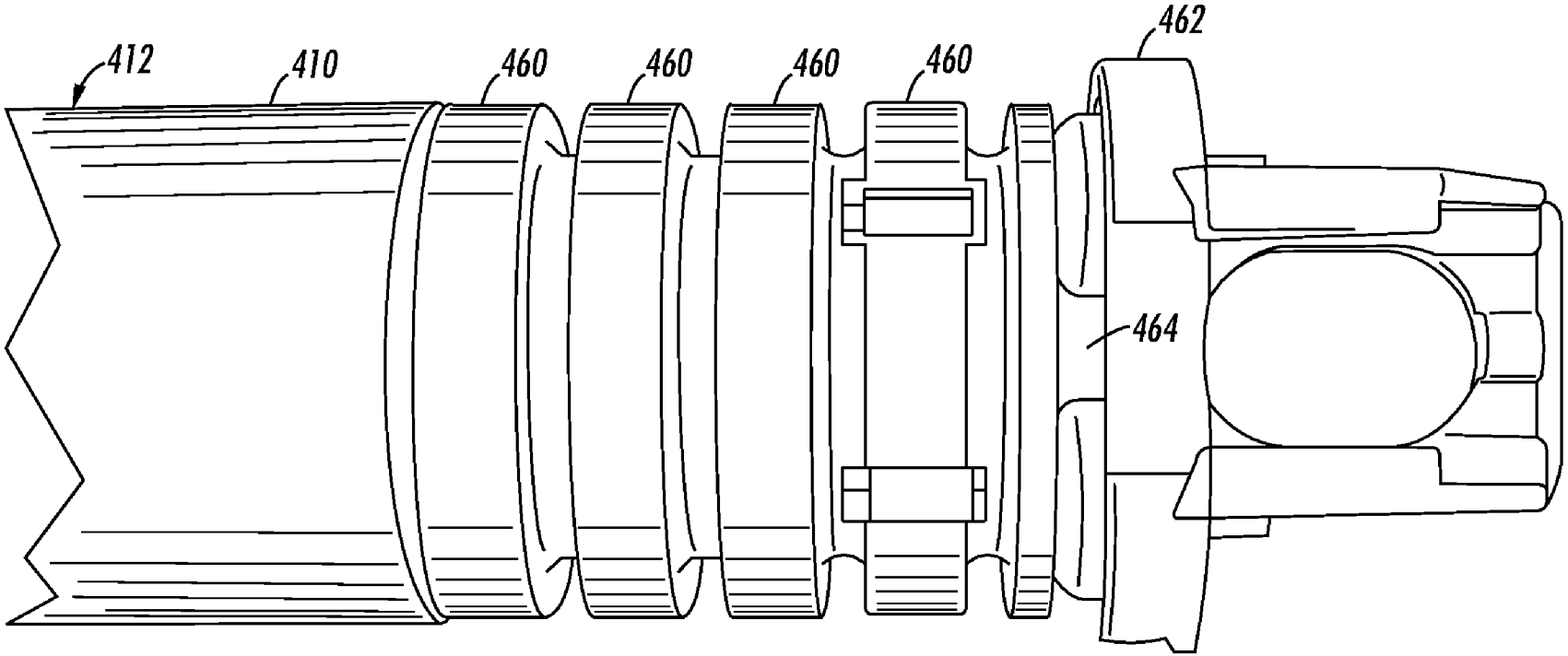
FIG. 4 illustrates another exemplary embodiment of a fuser.

As shown in FIG. 2, a guide 260 is located inside of fuser belt 210. The guide 260 includes a guide surface 262 facing the inner surface 214 of the fuser belt 210. The guide surface 262 is curved convexly and periodically contacts the inner surface 214 during rotation of fuser belt 210. The fuser 200 can include two or more such inner guides disposed axially along the fuser belt 210. FIG. 4 shows an exemplary embodiment including inner guides 460 and an end guide 462. When assembled, the inner guides 460 are located inside of fuser belt 410.

In embodiments, the fuser 200 includes a load member 264 adapted to apply a load to the heater housing 244 to urge the heating surface 237 of the nip heating element 236 into contact with the inner surface 214 of fuser belt 210 at the region of nip 224. The load member 264 extends axially along the fuser belt 210. The load member 264 can comprise, e.g., a metal or metal alloy. In embodiments, the heating surface 237 is planar, as shown. The load member 264 causes the heating surface 237 to push down on the fuser belt 210 to elastically deform the fuser belt 210 at the nip 224 to have a substantially planar shape. In embodiments, substantially the entire heating surface 237 contacts the inner surface 214 of fuser belt 210.

In embodiments, the heating surfaces 233, 235 also contact the inner surface 214 of fuser belt 210. The heating surfaces 233, 235 can be planar, as shown in FIG. 2, or have a curvature like the inner surface 212 of fuser belt 210 facing the heating surfaces 233, 235.

During operation, a medium 275 is fed to the nip 224. The medium 275 can be, e.g., a paper sheet with at least one toner image. At the nip 224, the fusing surface 212 of the fuser belt 210 and the outer surface 222 of pressure roll 220 contact opposite faces of the medium 275. The heating surfaces 233, 235, 237 supply thermal energy to the fuser belt 210 to heat the fusing surface 212 to a sufficiently-high temperature to heat medium 275 and toner carried on the medium 275, in contact with the fusing surface 212, to fuse the toner. The first pre-nip heating element 232 and second pre-nip heating element 234 (and adjacent portions of the heater housing 244 heated by these pre-nip heating elements) pre-heat a portion of the fuser belt 210 as the portion rotates past the heating surfaces 233, 235, before rotating further to the nip 224. In embodiments, the pre-heated portion of the fuser belt 210 can enter the nip 224 at or above the temperature set point for fusing toner onto media fed to the nip 224. At the nip 224, the nip heating element 236 supplies additional thermal energy to the fuser belt 210.

In the fuser 200, a typical dwell time is about 20 ms. In embodiments, the arc length of the portion of the fuser belt 210 heated by the first pre-nip heating element 232, second pre-nip heating element 234 and nip heating element 236 is equal to at least the media dimension in the process direction A. When the first pre-nip heating element 232 and second pre-nip heating element 234 pre-heat the fuser belt 210 to at least the temperature set point, the amount of work that the nip heating element 236 then needs to supply to fuse toner on media at the nip 224 is reduced as compared to heating the fuser belt 210 only at nip 224. When the pre-heated portion of fuser belt 210 arrives at the nip 224 at about the temperature set point or higher, the nip heating element 236 needs to only supply an additional amount of thermal energy sufficient to increase the temperature of the toner and media to the fusing temperature. The fusing temperature can be, e.g., about 180° C. to about 210° C. for different media weights. In fuser 200, media can be contacted with the fuser belt 210 at or above the temperature set point for about the entire dwell time to produce a high toner fix level on media.

In embodiments, a sensor 280 (e.g., optical sensor) can be located upstream of the nip 224 to sense the arrival of medium 275 at the nip 224. The sensor 280 can be connected to controller 248. By sensing the arrival time of medium 275 at the nip 224, power can be supplied from the power supply 246 to the first pre-nip heating element 232, second pre-nip heating element nip 234, and nip heating element 236 by the power supply 246 to heat the fusing surface 212 to the desired temperature before medium 275 arrives at the nip 224. In embodiments, once medium 275 has passed through nip 224, the supply of power to the first pre-nip heating element 232, second pre-nip heating element nip 234, and nip heating element 236 by the power supply 246 can be turned OFF until sensor 280 senses the arrival of the next medium at nip 224.

Figure 5:
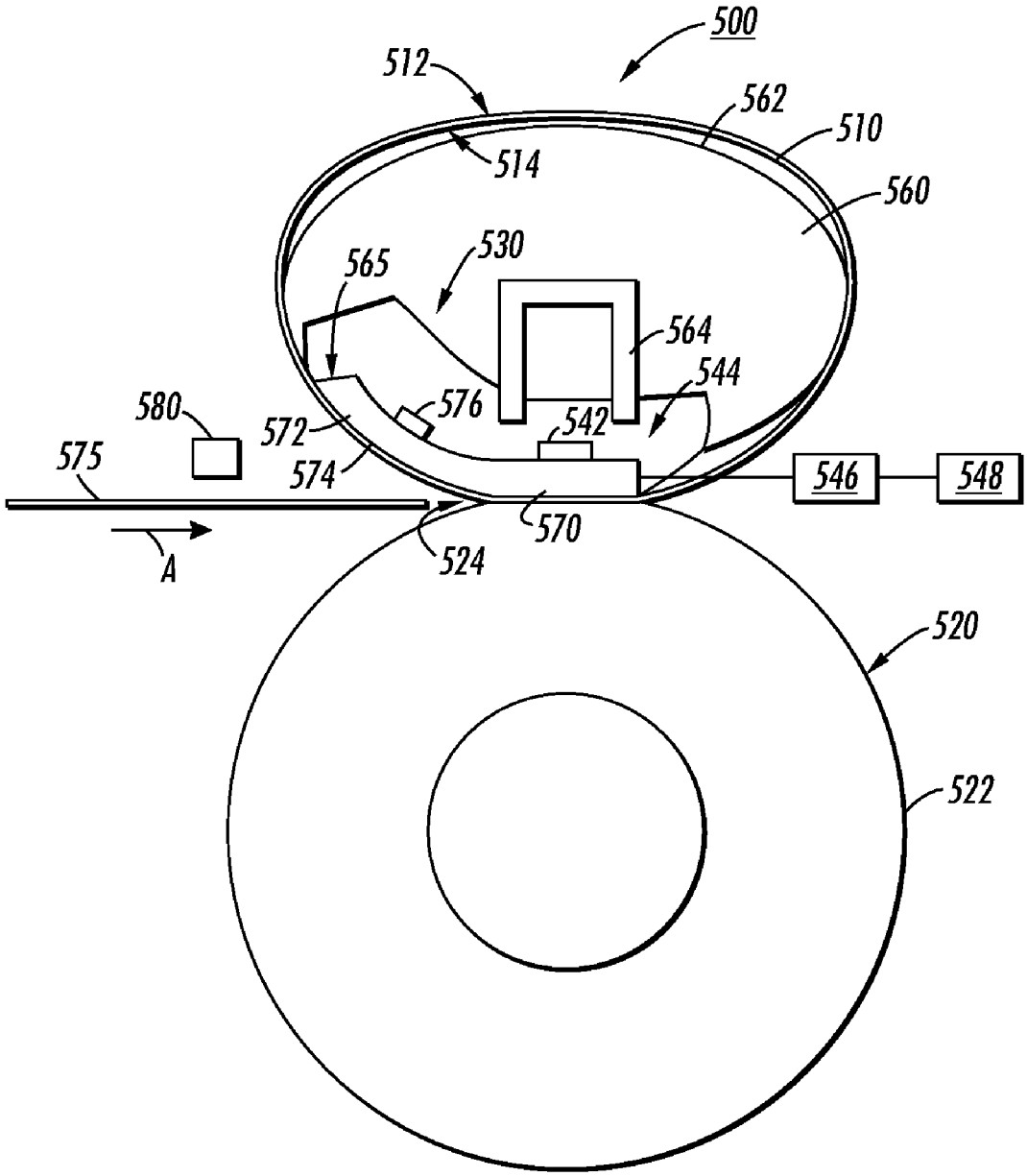
FIG. 5 illustrates another exemplary embodiment of a fuser.

FIG. 5 illustrates a fuser 500 according to another exemplary embodiment. The fuser 500 includes a continuous fuser belt 510 having an outer, fusing surface 512 and an inner surface 514. In embodiments, the fuser belt 510 can be made, e.g., of the same material and have the same un-deformed configuration as fuser belt 210 shown in FIG. 2. The fuser 500 further includes a pressure roll 520 having an outer surface 522. The fusing surface 512 and the outer surface 522 contact each other at a nip 524. The fuser belt 510 rotates counter-clockwise, and the pressure roll 520 clockwise, to convey media, such as medium 575, through the nip 524 in the direction A.

The fuser 500 further includes a heater 530 located inside of fuser belt 510. In embodiments, the heater 530 is stationary. The heater 530 heats a portion of the fuser belt 510 before the portion rotates to the nip 524, and also heats the pre-heated portion of the fuser belt 510 at the nip 524.

As shown, the heater 530 includes one heating element 565 having a heating surface 574 facing the inner surface 514 of fuser belt 510. In embodiments, the heating surface 574 can be continuous, as shown. The heating surface 574 includes a planar portion 570 located at nip 524 and a curved portion 572 extending clockwise from planar portion 570. The portion 570 contacts the inner surface 514 of fuser belt 510 at nip 524, and the portion 572 contacts a portion of the inner surface 514 extending clockwise from the nip 524. As shown, the fuser belt 510 substantially conforms to the shape of the heating surface 574. In embodiments, the heating surface 574 can extend clockwise by an angle up to about 45° from nip 524.

Thermistors 542, 576 are shown operatively associated with portions 570, 572 of the heating surface 574. In embodiments, two or more, axially-spaced thermistors can be used with each portion 570, 572.

The heater housing 544 extends axially along the fuser roll 510. In embodiments, the heating element 565 is secured to the heater housing 544. For example, the heating element 565 can be fitted in an axially-extending recess formed in the heater housing 544, and bonded to the heater housing 544. The heater housing 544 can be made of, e.g., a polymeric material.

In embodiments, a power supply 546 is connected to the heating element 565. A controller 548 is connected to power supply 546 to control the supply of power to the heating element 565. In embodiments, the controller 548 is also connected to the thermistors 542, 576.

In embodiments, heating element 565 includes a substrate with a surface (not shown) opposite to heating surface 574, and resistive traces (not shown) formed on the surface. The resistive traces can be circumferentially spaced from each other, as well as spaced from each other in the axial direction of fuser belt 510 (such in heater 230) to be able to heat substantially the entire heating surface 574, or only a selected portion of heating surface 574. Such axially-spaced resistive traces can be caused to produce heat by controller 548 to heat a selected axial length of the fusing surface 512 based on the dimension of media (in the axial direction of fuser belt 510) fed to the nip 524. The substrate, resistive traces, electrical conductors and contacts of heating element 565 can comprise, e.g., the same materials as that of the heater 230.

The resistive traces of heating element 565 can be covered by a protective, thermally-conductive, dielectric material (not shown) to form the heating surface 574. In embodiments, the resistive traces are connected to power supply 546.

As shown in FIG. 5, a guide 560 is located inside of the fuser belt 510. The guide 560 includes a curved guide surface 562 configured to periodically contact the inner surface 514 during rotation of the fuser belt 510. In embodiments, the fuser 500 can include two or more guides arranged axially along the fuser belt 510, such as shown in FIG. 3.

In embodiments, the heating surface 574 extends axially along the fuser belt 510. The heating surface 574 is configured to heat a portion of the inner surface 514 of fuser belt 510 by conduction as the fuser belt 510 rotates relative to the stationary heating surface 574. A thermally-conductive lubricant can be applied to the inner surface 514 of fuser belt 510.

In embodiments, the fuser 500 includes an axially-extending load member 564, which applies a load to the heater housing 544 to urge the heating surface 574 into contact with the inner surface 514 of fuser belt 510 at the region of nip 524. The load member 564 causes the portion 570 of heating surface 574 to push against the fuser belt 510 to elastically deform the fuser belt 510 at the nip 524 to have a planar shape. In embodiments, substantially the entire planar portion 570 contacts the inner surface 514 of fuser belt 510.

In embodiments, the portion 572 of heating surface 574 contacts the inner surface 514 of fuser belt 510, with the portion of the fuser belt 510 facing the portion 572 substantially retaining a curved shape.

During operation, a medium 575 is fed to the nip 524 in direction A. At the nip 524, the fusing surface 512 and the outer surface 522 contact opposite faces of the medium 575. The heating surface 574 supplies thermal energy to the fuser belt 510 to heat a portion of the fusing surface 512 to a sufficiently-high temperature (i.e., at least the toner fusing temperature) to heat the medium 575 and toner on the medium 575, during contact with the fusing surface 512, to fuse the toner on the medium 575. The arc length of the portion of the fuser belt 510 heated by the heating surface 574 equals at least the media dimension in the direction A. The portion 572 of heating surface 574 can pre-heat a portion of the fuser belt 510 before the portion reaches the nip 524, such that the portion of fuser belt 510 enters the nip 524 at or above the temperature set point for fusing toner on media fed to the nip 524. At the nip 524, the portion 570 of heating surface 574 supplies additional thermal energy to the fuser belt 510, which is transferred to media. When a portion of the fuser belt 510 is pre-heated in this manner, the amount of work that needs to then be provided by the heating element 565 to fuse toner on media at the nip 524 is reduced, and media can be contacted with the fuser belt 510 at the temperature set point for about the entire dwell time.

In embodiments, a sensor 580 can be positioned to sense the arrival of media, such as medium 575, at the nip 524. The sensor 580 can be connected to controller 548. The power supply 546 can supply voltage to the heating element 565 to heat the fusing surface 512 to the desired temperature before the medium 575 arrives at nip 524. In embodiments, once medium 575 has passed through nip 524, the supply of power to heating element 565 by the power supply 546 can be turned OFF until the sensor 580 senses the next medium approaching nip 524.

Figure 6:
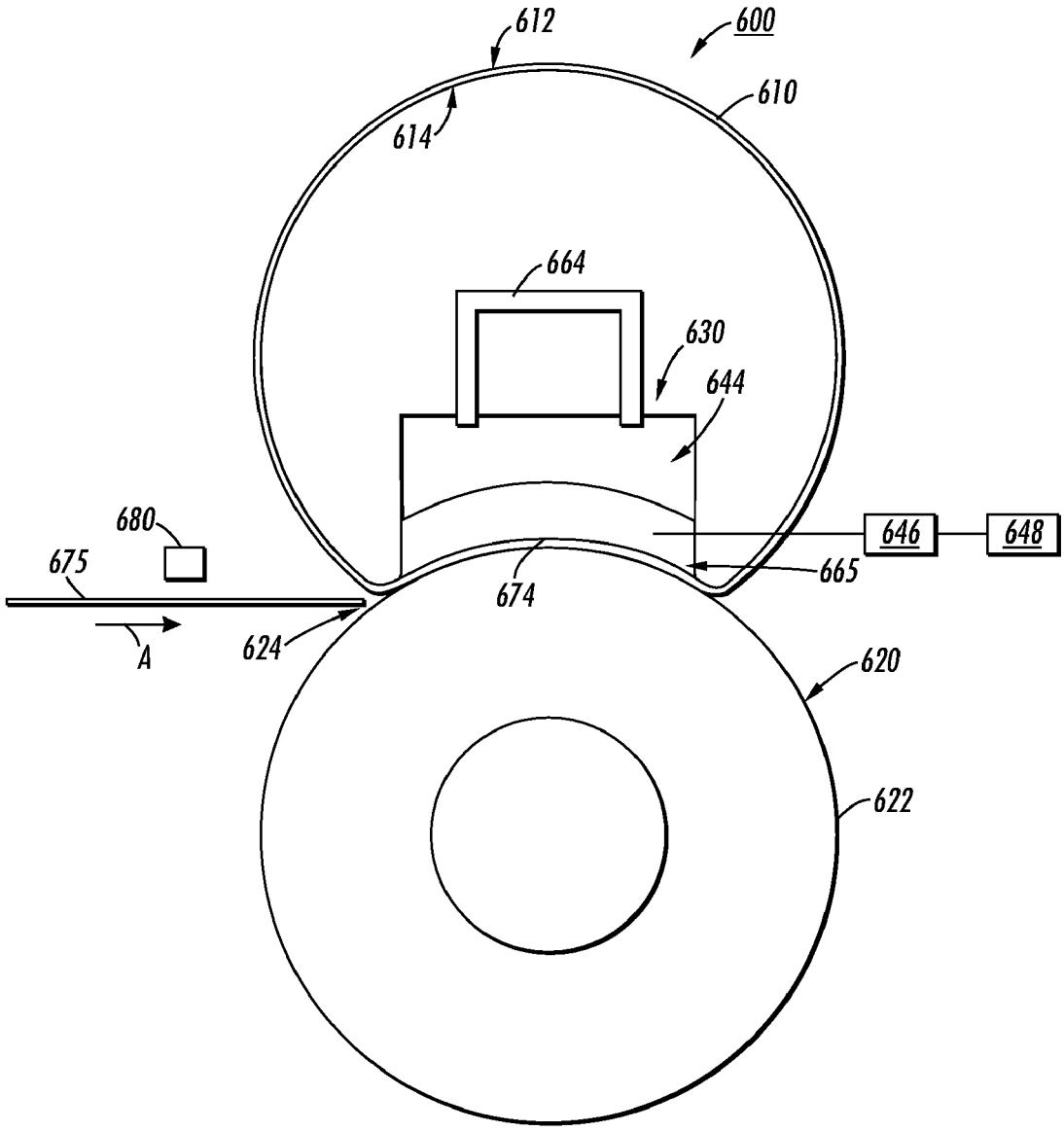
FIG. 6 illustrates another exemplary embodiment of a fuser.

FIG. 6 illustrates a fuser 600 according to another exemplary embodiment. The fuser 600 includes a continuous fuser belt 610 having an outer, fusing surface 612 and an inner surface 614. The fuser belt 610 can be made, e.g., of the same material and have the same un-deformed configuration as fuser belt 210 shown in FIG. 2. The fuser 600 further includes a pressure roll 620 having an outer surface 622 contacting the fusing surface 612 at a nip 624. The fuser belt 610 rotates counter-clockwise, and the pressure roll 620 clockwise, to convey media, such as medium 675, through the nip 624 in process direction A.

The fuser 600 further includes a heater 630 inside of fuser belt 610. In embodiments, the heater 630 is stationary. As shown, the heater 630 includes a single heating element 665 with a concavely-curved heating surface 674. As shown, the fuser belt 610 is deformed when in contact with the pressure roll 620 to have a concave curvature that matches the convex curvature (typically circular) of the outer surface 622 of pressure roll 620. The heating surface 674 and outer surface 622 can have about the same radius of curvature. The heating surface 674 urges the fuser belt 610 into contact with the outer surface 622 of pressure roll 620 at the nip 624. In embodiments, the arc length of heating surface 674 can be varied to vary the arc length of the fuser belt 610 in contact with the outer surface 622 to vary the contact time between the fusing surface 612 and media at nip 624. The heating surface 674 can extend over an angle of, e.g., about 15° to about 30°. The heating surface 674 supplies thermal energy to heat the fuser belt 610, which, in turn, heats media fed to nip 624.

In embodiments, the heating element 665 extends axially along the fuser roll 610. The heating element 665 can be bonded to a heater housing 644. The heater housing 644 can be made, e.g., of a polymeric material.

In embodiments, a power supply 646 is connected to the heating element 665. A controller 648 is connected to power supply 646 to control the supply of power to the heating element 665. The heater 630 can include at least one thermistor (not shown) connected to controller 648.

In embodiments, heating element 665 can include a substrate having a surface (not shown) opposite to heating surface 674, and resistive traces (not shown) formed on the surface. The resistive traces can be circumferentially spaced from each other, as well as spaced from each other in the axial direction of fuser belt 610, such in heater 230, to be able to heat substantially the entire heating surface 674, or only a selected portion of heating surface 674. The substrate, resistive traces, electrical conductors and contacts of heating element 665 can comprise, e.g., the same materials as the heater 230. The resistive traces of heating element 665 can be covered by a protective, thermally-conductive, dielectric material (not shown) to form the heating surface 674. In embodiments, the resistive traces are connected to power supply 646.

In embodiments, at least one guide (not shown) is located inside of the fuser belt 610, such as in fuser 200.

In embodiments, the heating surface 674 extends axially along the fuser belt 610. In embodiments, axially-spaced resistive traces of heating element 665 can be used to heat a selected axial length of the fusing surface 612 based on the dimension of media (in the axial direction) fed to the nip 624. The heating surface 674 is configured to heat a portion of the inner surface 614 of fuser belt 610 by thermal conduction as the fuser belt 610 rotates relative to the stationary heating surface 674. A thermally-conductive lubricant can be applied to the inner surface 614 of fuser belt 610.

In embodiments, the fuser 600 includes an axially-extending load member 664 adapted to apply a load to the heater housing 644 to urge the heating surface 674 into contact with the inner surface 614 of fuser belt 610, and the outer surface 612 into contact with the outer surface 622 of pressure roll 620. In embodiments, substantially the entire heating surface 674 is urged into contact with the inner surface 614 of fuser belt 610.

During operation, a medium, such as medium 675, is fed to the nip 624. At the nip 624, the fusing surface 612 and the outer surface 622 contact opposite faces of the medium 675. The heating surface 674 supplies thermal energy to the fuser belt 610 to heat the fusing surface 612 to a sufficiently-high temperature (i.e., at least the toner fusing temperature) to heat medium 675 and toner carried on the medium 675, which contact the fusing surface 612, to fuse the toner on the medium 675 at nip 624. The concavely-shaped outer surface 612 increases the size of nip 624. By increasing the size of the nip 624, media can be contacted with the fuser belt 610 at the temperature set point for about the entire dwell time.

In embodiments, a media sensor 680 can be positioned to sense the arrival of media, such as medium 675, at the nip 624. The sensor 680 can be connected to controller 648. The power supply 646 can supply voltage to the heating element 665 to heat the fusing surface 612 to the desired temperature before the medium 675 arrives at the nip 624. In embodiments, once medium 675 has passed through nip 624, the supply of power to heating element 665 by the power supply 646 can be turned OFF until the sensor 680 senses the next medium approaching nip 624.

Figure 7:
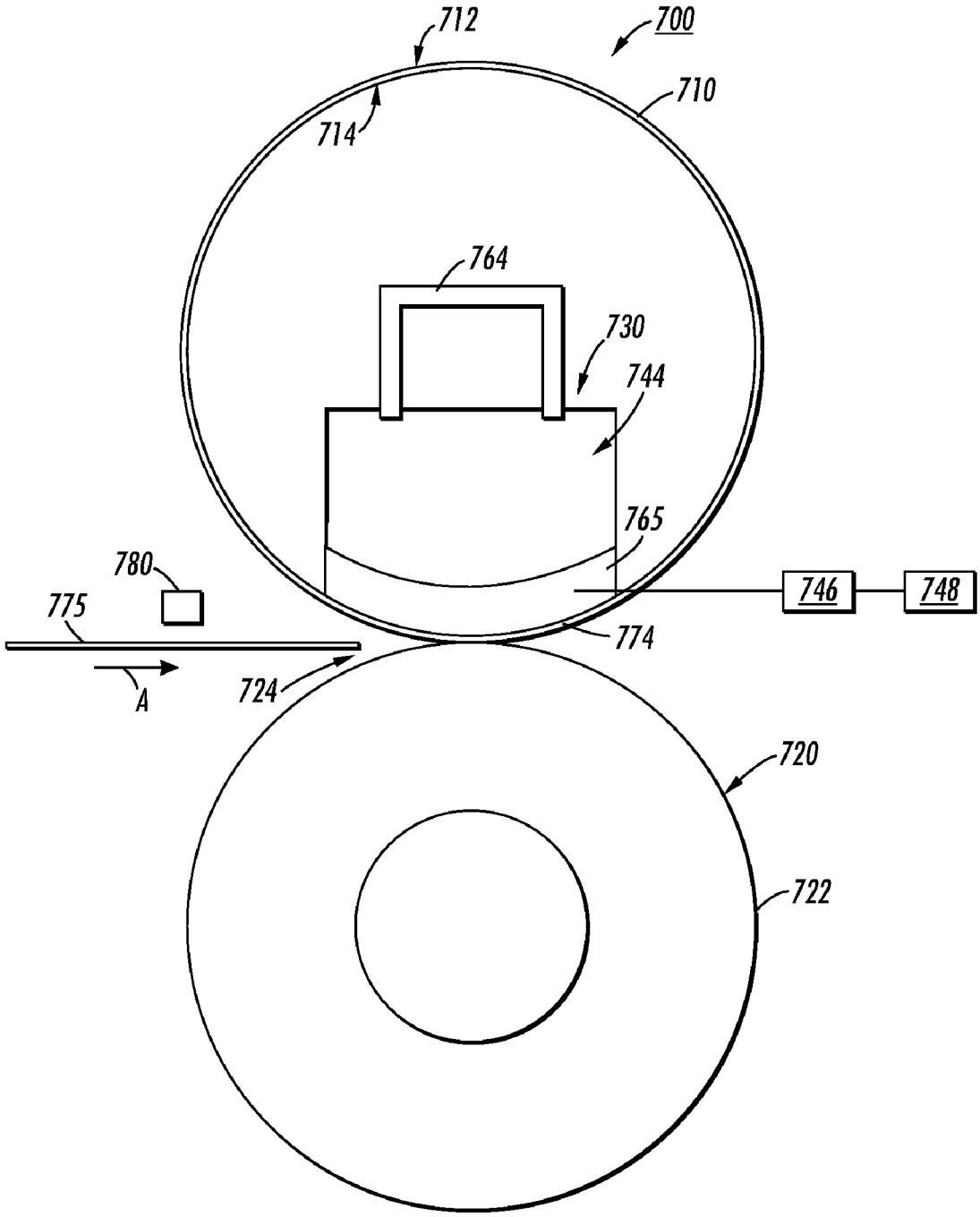
FIG. 7 illustrates another exemplary embodiment of a fuser.

FIG. 7 illustrates a fuser 700 according to another exemplary embodiment. The fuser 700 includes a continuous fuser belt 710 having an outer, fusing surface 712 and an inner surface 714. In embodiments, the fuser belt 710 can be made, e.g., of the same material as fuser belt 210 shown in FIG. 2. Embodiments of the fuser belt 710 are more rigid than the fuser belts 210, 510, 610, for example. In embodiments, the fuser belt 710 is not deformed by contact with the pressure roll 720 and retains a cylindrical shape, as shown. The material of the more-rigid fuser belt 710 can be the same material as that of fuser belts 210, 510, 610 (e.g., steel, stainless steel, or the like), but the material of fuser belt 719 can have a greater thickness than the fuser belts 210, 510, 610. In other embodiments, the material of fuser belt 710 can have about the same thickness as the fuser belts 210, 510, 610 (or be thinner than the fuser belts 210, 510, 610), but be more rigid (stiffer) than the material of fuser belts 210, 510, 610 (and also have a sufficiently-high thermal conductivity). In embodiments, it is desirable for fuser belt 710 to have a small thickness and low thermal mass to reduce the amount of energy needed to heat the fuser belt 710 to the desired temperature for fusing toner. The fuser 700 further includes a pressure roll 720 having an outer surface 722. The fusing surface 712 and the outer surface 722 contact each other at a nip 724. The fuser belt 710 rotates counter-clockwise, while the pressure roll 720 rotates clockwise, to convey media, such as medium 775, through the nip 724 in process direction A.

The fuser 700 further includes a heater 730 located inside of fuser belt 710. In embodiments, the heater 730 is stationary. As shown, the heater 730 includes a single heating element 765 with a convexly-curved heating surface 774 contacting the inner surface 714 of fuser belt 710. In embodiments, the arc length of heating surface 774 can be varied to vary the arc length of the fuser belt 710 heated by the heater 730. The heating surface 774 can extend over an angle of, e.g., about 15° to about 30°. The heating surface 774 heats the fuser belt 710, which, in turn, heats media fed to nip 724.

In embodiments, the heating element 765 extends axially along the fuser roll 710. The heating element 765 can be bonded to a heater housing 744. The heater housing 744 can be made, e.g., of a polymeric material.

In embodiments, a power supply 746 is connected to the heating element 765. A controller 748 is connected to power supply 746 to control the supply of power to the heating element 765. The heater 730 can include at least one thermistor (not shown) connected to controller 748.

In embodiments, heating element 765 can include a substrate having a surface (not shown) opposite to heating surface 774, and resistive traces (not shown) formed on the surface. The resistive traces can be circumferentially spaced from each other, as well as spaced from each other in the axial direction of fuser belt 710, such as in heater 230, to allow heating of substantially the entire heating surface 774, or only a portion of the heating surface 774. The substrate, resistive traces, electrical conductors and contacts of heating element 765 can comprise, e.g., the same materials as that of the heater 230. In embodiments, the resistive traces of heating element 765 can be covered by a protective, thermally-conductive, dielectric material (not shown) to form the heating surface 774. In embodiments, the resistive traces are connected to power supply 746.

In embodiments, at least one guide (not shown) is located inside of the fuser belt 710, such as in fuser 200.

In embodiments, the heating surface 774 extends axially along the fuser belt 710. In embodiments, axially-spaced resistive traces of heating element 765 can be activated under control of controller 748 to heat a selected axial length of the fusing surface 712 based on the dimension of media (in the axial direction) fed to the nip 724. The heating surface 774 heats a portion of the inner surface 714 of fuser belt 710 by thermal conduction as the fuser belt 710 rotates relative to the stationary heating surface 774. A thermally-conductive lubricant can be applied to the inner surface 714 of fuser belt 710.

The fuser 700 includes an axially-extending load member 764, which applies a load to the heater housing 744 to urge the heating surface 774 into contact with the inner surface 714 of fuser belt 710. In embodiments, substantially the entire heating surface 774 contacts the inner surface 714 of fuser belt 710.

During operation, a medium 775 is fed to the nip 724. At the nip 724, the fusing surface 712 and the outer surface 722 contact opposite faces of the medium 775. The heating surface 774 heats the fusing surface 712 to a sufficiently-high temperature to heat medium 775 and toner carried on the medium 775, which contact the fusing surface 712, to fuse the toner on the medium 775 at nip 724. The heating surface 774 heats a portion of the fuser belt 710 to at least the temperature set point for fusing toner on media fed to the nip 724. By pre-heating a portion of the fuser belt 710 before the portion rotates to nip 724, media can be contacted with the fuser belt 710 at the temperature set point for about the entire dwell time.

In embodiments, a sensor 780 can be positioned to sense the arrival of media, such as medium 775, at the nip 724. The sensor 780 can be connected to controller 748. Voltage can be applied to the heating element 765 to heat the fusing surface 712 to the desired temperature before media arrive at the nip 724. In embodiments, once a medium has passed through nip 724, the supply of power to heating element 765 by the power supply 746 can be turned OFF until the sensor 780 senses the arrival of the next medium at nip 724.

Embodiments of the fusers 500, 600, 700 can be used, e.g., in the printing apparatus 100 in place of the fuser 110.

It will be appreciated that various ones of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art, which are also intended to be encompassed by the following claims.

What is claimed is:

1. A fuser, comprising:

a pressure roll including an outer surface;

a continuous fuser belt including an inner surface and an outer fusing surface contacting the outer surface at a nip; and a heater disposed inside of the fuser belt, the fuser belt being rotatable relative to the heater, the heater including at least one heating surface contacting the inner surface and adapted to pre-heat a portion of the fuser belt before the portion is rotated to the nip, and to heat the pre-heated portion at the nip.

2. The fuser of claim 1, wherein the fuser belt is comprised of a metal or metal alloy.

3. The fuser of claim 1, wherein the heater comprises a single continuous heating surface which includes a planar portion disposed at the nip and a convexly-curved portion which extends in a clockwise direction from the planar portion, the fuser belt substantially conforming to the shape of the planar portion and curved portion of the heating surface.

4. The fuser of claim 1, wherein the heater comprises:

a nip heating element disposed at the nip, the nip heating element including a first heating surface which contacts a first portion of the inner surface of the fuser belt at the nip; and a pre-nip heating element disposed clockwise from the nip heating element, the pre-nip heating element including a second heating surface which contacts a second portion of the inner surface of the fuser belt spaced in a clockwise direction from the first portion;

wherein, when the fuser belt is rotated counter-clockwise, the pre-nip heating element pre-heats the first portion of the fuser belt before the first portion is rotated to the nip, and the nip heating element is adapted to heat the pre-heated first portion at the nip.

5. The fuser of claim 1, further comprising:

a heater housing;

a load member which applies a load to the heater housing to urge the heating surface into contact with the inner surface of the fuser belt at the nip; and at least one guide disposed inside of the fuser belt, each guide including a surface configured to contact the inner surface of the fuser belt during rotation of the fuser belt relative to the heater.

6. The fuser of claim 1, wherein the heater comprises a plurality of axially-spaced resistive traces formed on a surface of a substrate opposite to the heating surface, the resistive traces being adapted to heat respective zones of the heating surface.

7. The fuser of claim 1, wherein the fuser belt is cylindrical-shaped and comprised of a metal or metal alloy;

the heating surface is convex-shaped; and the heating surface contacts the inner surface over an angle of about 15° to about 30°.

8. A printing apparatus, comprising:

a fuser according to claim 1;

a power supply connected to the heater;

a controller connected to the power supply; and a sensor connected to the controller for sensing a medium fed to the nip;

wherein the controller is adapted to control the power supply to supply power to the heating element to heat the heating surface when the sensor senses the medium.

9. A method of fusing toner on a medium, comprising:

feeding a medium having toner thereon to a nip between an outer fusing surface of a continuous fuser belt and an outer surface of a pressure roll;

rotating the fuser belt relative to a heater disposed inside of the fuser belt, the heater including at least one heating surface contacting an inner surface of the fuser belt, the heating surface pre-heating a portion of the fuser belt before the portion is rotated to the nip and heating the pre-heated portion of the fuser belt at the nip; and contacting the medium with the fusing surface and the outer surface at the nip to fuse the toner onto the medium.

10. The method of claim 9, wherein:

the fuser belt is comprised of a metal or a metal alloy;

the heater comprises a single continuous heating surface which includes a planar portion disposed at the nip and a convexly-curved portion which extends in a clockwise direction from the planar portion, the fuser belt substantially conforming to the shape of the planar portion and curved portion of the heating surface.

11. The method of claim 9, wherein:

the fuser belt is comprised of a metal or a metal alloy; and the heater comprises:

a nip heating element disposed at the nip, the nip heating element including a first heating surface which contacts a first portion of the inner surface of the fuser belt at the nip; and a pre-nip heating element spaced in a clockwise direction from the nip heating element, the pre-nip heating element includes a second heating surface which contacts a second portion of the inner surface of the fuser belt extending clockwise from the nip;

wherein the fuser belt is rotated counter-clockwise and the pre-nip heating element pre-heats the first portion of the fuser belt before the first portion is rotated to the nip and the nip heating element heats the pre-heated first portion at the nip.

12. The method of claim 9, wherein the fuser belt is cylindrical-shaped and comprised of a metal or metal alloy;

the heating surface is convex-shaped; and the heating surface contacts the inner surface over an angle of about 15° to about 30°.

13. The method of claim 9, further comprising:

sensing the arrival of the medium at the nip with a sensor connected to a controller; and controlling a power supply connected to the heater with the controller to supply power to the heater to heat the heating surface to at least a fusing temperature of the toner before the medium arrives at the nip.

14. The method of claim 13, wherein the medium has a dimension, and the heater is controlled with the controller to heat a selected portion of the dimension of the medium to at least the fusing temperature of the toner with the heating surface.

* * * * *